US007267063B2

(12) United States Patent
Fukao

(10) Patent No.: US 7,267,063 B2
(45) Date of Patent: Sep. 11, 2007

(54) EMBROIDERY PRESSER FOR EMBROIDERY MACHINE

(75) Inventor: Hiroaki Fukao, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/386,893

(22) Filed: Mar. 23, 2006

(65) Prior Publication Data

US 2006/0213409 A1 Sep. 28, 2006

(30) Foreign Application Priority Data

Mar. 24, 2005 (JP) ..... 2005-086011

(51) Int. Cl.
*D05B 29/00* (2006.01)
*D05B 69/00* (2006.01)

(52) U.S. Cl. ..... 112/236

(58) Field of Classification Search ..... 112/235, 112/236, 237, 238, 239, 240
See application file for complete search history.

(56) References Cited

U.S. PATENT DOCUMENTS 300,434 A * 6/1884 Baker ..... 112/101
2,874,663 A * 2/1959 Matuzas ..... 112/236
3,759,202 A * 9/1973 Jean-Blanc ..... 112/239
4,292,907 A * 10/1981 Gilbride et al. ..... 112/236
4,709,644 A * 12/1987 Fujihara et al. ..... 112/237
5,220,877 A * 6/1993 Redovian ..... 112/237
5,590,614 A * 1/1997 Murata et al. ..... 112/237

FOREIGN PATENT DOCUMENTS

JP A 59-77889 5/1984
JP A 59-77890 5/1984
JP Y-62-32549 8/1987

* cited by examiner

*Primary Examiner*—Ismael Izaguirre
(74) *Attorney, Agent, or Firm*—Oliff & Berridge, PLC

(57) ABSTRACT

An embroidery presser for an embroidery machine includes a presser bar having a lower end, an operation lever operated so that the presser bar is vertically moved, a needle bar movable vertically, a holder attached to the lower end of the presser bar, a presser foot supported by the holder so as to be vertically movable and having a lower end with a cloth pressing portion intermittently pressing workpiece cloth by a vertical movement of the needle bar, a biasing member normally biasing the presser foot relative to the holder elastically downward, and a presser lifting mechanism abutting the sewing machine frame when the presser bar is lifted by operation of the operation lever, thereby lifting the presser foot relative to the holder.

5 Claims, 6 Drawing Sheets

EMBROIDERY PRESSER FOR EMBROIDERY MACHINE

CROSS-REFERENCE TO RELATED APPLICATIONS

This application is based upon and claims the benefit of priority from the prior Japanese Patent Application No. 2005-86011, filed on Mar. 24, 2005, the entire contents of which are incorporated herein by reference.

1. Technical Field

The present disclosure relates to an embroidery presser for an embroidery machine, attached to a lower end of a presser bar of the embroidery machine for intermittently pressing workpiece cloth by vertical movement of a needle bar, and more particularly to a lifting stroke of a cloth pressing portion in a case where the presser bar is lifted by operation of a presser lifting lever.

2. Related Art

An embroidery machine has conventionally been put into practical use and constructed to press workpiece cloth intermittently in synchronization with vertical movement of a needle bar. For example, JP-Y-62-32549 discloses a darning presser (corresponding to the embroidery presser of the present application) comprising a mounting member fixed to a lower end of a presser bar which is supported on a sewing machine frame so as to be vertically movable, a slide shaft which is supported on the mounting member, a compression spring urging the slide shaft downward, and a cloth presser foot secured on a lower end of the slide shaft and having a cloth pressing portion pressing workpiece cloth. In the aforementioned construction, the workpiece cloth is pressed by the cloth pressing portion while a sewing needle attached to a lower end of a needle bar is passing through the workpiece cloth. When the needle bar is lifted upward such that the sewing needle is pulled out of the workpiece cloth, the cloth pressing portion is also lifted upward, thereby releasing the workpiece cloth from the pressed state.

In the above-described darning presser, however, the cloth pressing portion having been lifted up is located lower than the height of an embroidery frame holding the workpiece cloth to be embroidered even when the presser lifting lever is operated so that the presser bar is switched to a lifted position. Accordingly, the cloth pressing portion needs to be manually raised upward in replacement of the embroidery frame with another.

A plurality of embroidery frames with different sizes are generally prepared in order that various sizes of embroidery patterns may be sewn. However, when an embroidering device of the embroidery machine has no function of determining the size of the embroidery frame, it is supposed that an operator may erroneously select an embroidery pattern which is so large that the embroidery pattern cannot be sewn within a sewing range of the embroidery frame and further that the operator may in advance operate the embroidery machine to move only the embroidery frame, in order to confirm the size of the embroidery frame and/or a sewing position. In this case, the embroidery frame would collide against the cloth pressing portion even when the presser bar assumes the lifted position.

SUMMARY

Therefore, an object of the present disclosure is to provide an embroidery presser for an embroidery machine, which is incorporated with a mechanism that can increase a lifting stroke of a cloth pressing portion when the presser bar is lifted by operation of a presser-lifting operation lever.

The disclosure provides an embroidery presser for an embroidery machine, comprising a sewing machine frame, a presser bar having a lower end, a presser-lifting operation lever operated so that the presser bar is vertically moved, a needle bar movable vertically, a holder attached to the lower end of the presser bar, a presser foot supported by the holder so as to be vertically movable and having a lower end provided with a cloth pressing portion intermittently pressing workpiece cloth by a vertical movement of the needle bar, a biasing member normally biasing the presser foot relative to the holder member elastically downward, and a presser lifting mechanism abutting the sewing machine frame when the presser bar is lifted by operation of the operation lever, thereby lifting the presser foot relative to the holder.

In the above-described construction, a presser lifting mechanism is provided which abuts the sewing machine frame when the presser bar is lifted by operation of the operation lever, thereby lifting the presser foot relative to the holder. Accordingly, the cloth pressing portion can be located higher when the presser bar has been switched to the lifted position, namely, a lifting amount of the cloth pressing portion can be increased. Consequently, since no contact or interference occurs between the cloth pressing portion and the embroidery frame in the replacement of the embroidery frame, the embroidery frame can be attached and detached easily and efficiently, whereupon the working efficiency can be improved in the embroidery sewing.

BRIEF DESCRIPTION OF THE DRAWINGS

Other objects, features and advantages of the present invention will become clear upon reviewing the following description of the embodiment with reference to the accompanying drawings, in which.

DETAILED DESCRIPTION

Figure 1:
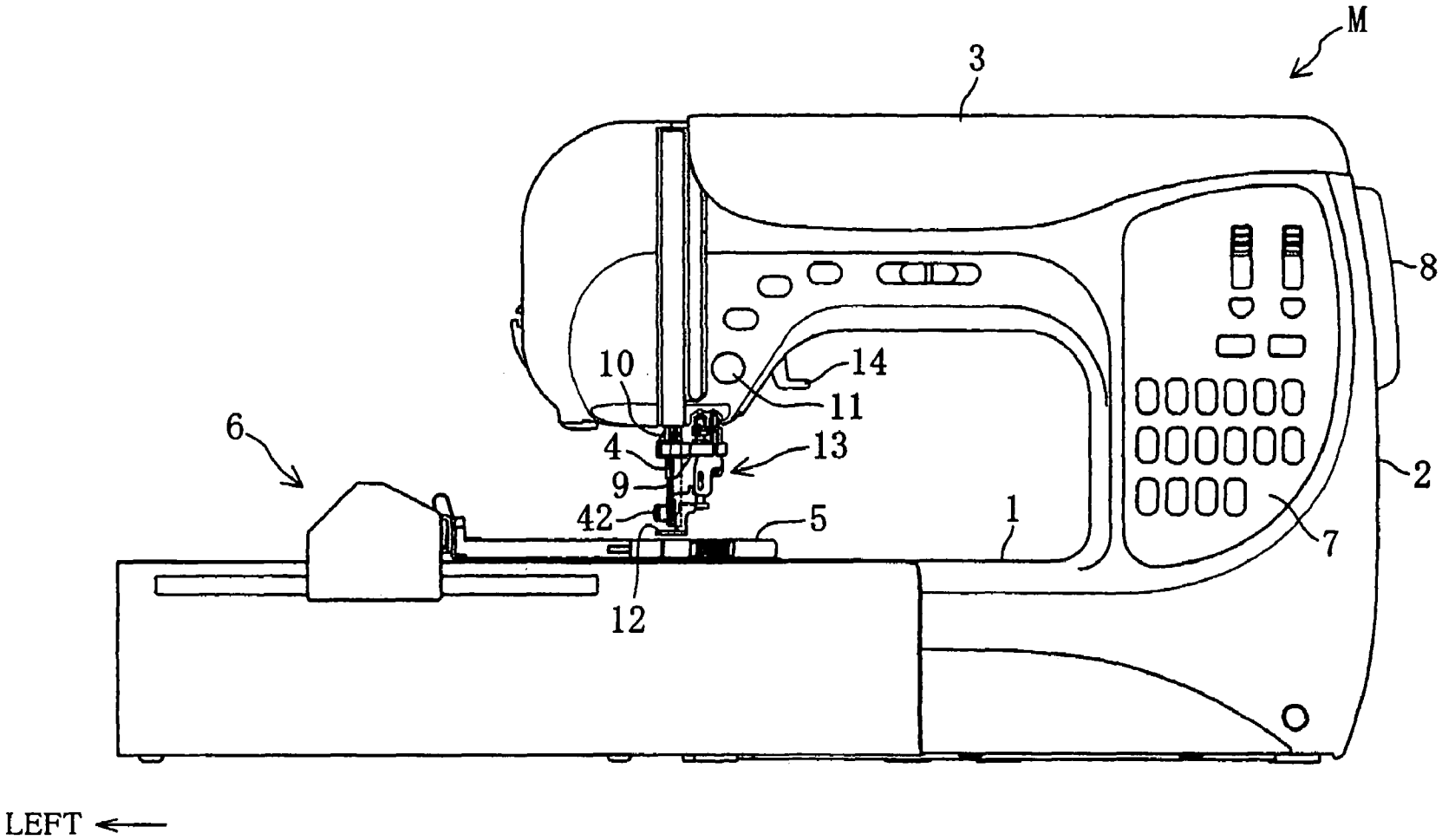
FIG. 1 is a front view of an embroidery machine of one illustrative example in accordance with the disclosure.

One embodiment of the invention will be described with reference to the accompanying drawings. Referring first to FIG. 1, a sewing machine M which can perform embroidery sewing will be described in brief. The sewing machine M is capable of performing embroidery sewing as well as normal sewing. In the embroidery sewing, an embroidery frame transferring device 6 is attached to the sewing machine M and an embroidery frame is used. The sewing machine M comprises a sewing bed 1, a pillar 2 standing at a right end of the bed 1 and a sewing arm 3 which extends from an upper end of the pillar 2 leftward so as to be opposed to the bed 1. The embroidery frame transferring device 6 is detachably attached to a left end of the bed 1 to move the embroidery frame 5 holding workpiece cloth W to be embroidered in two directions perpendicular to each other.

Figure 2:
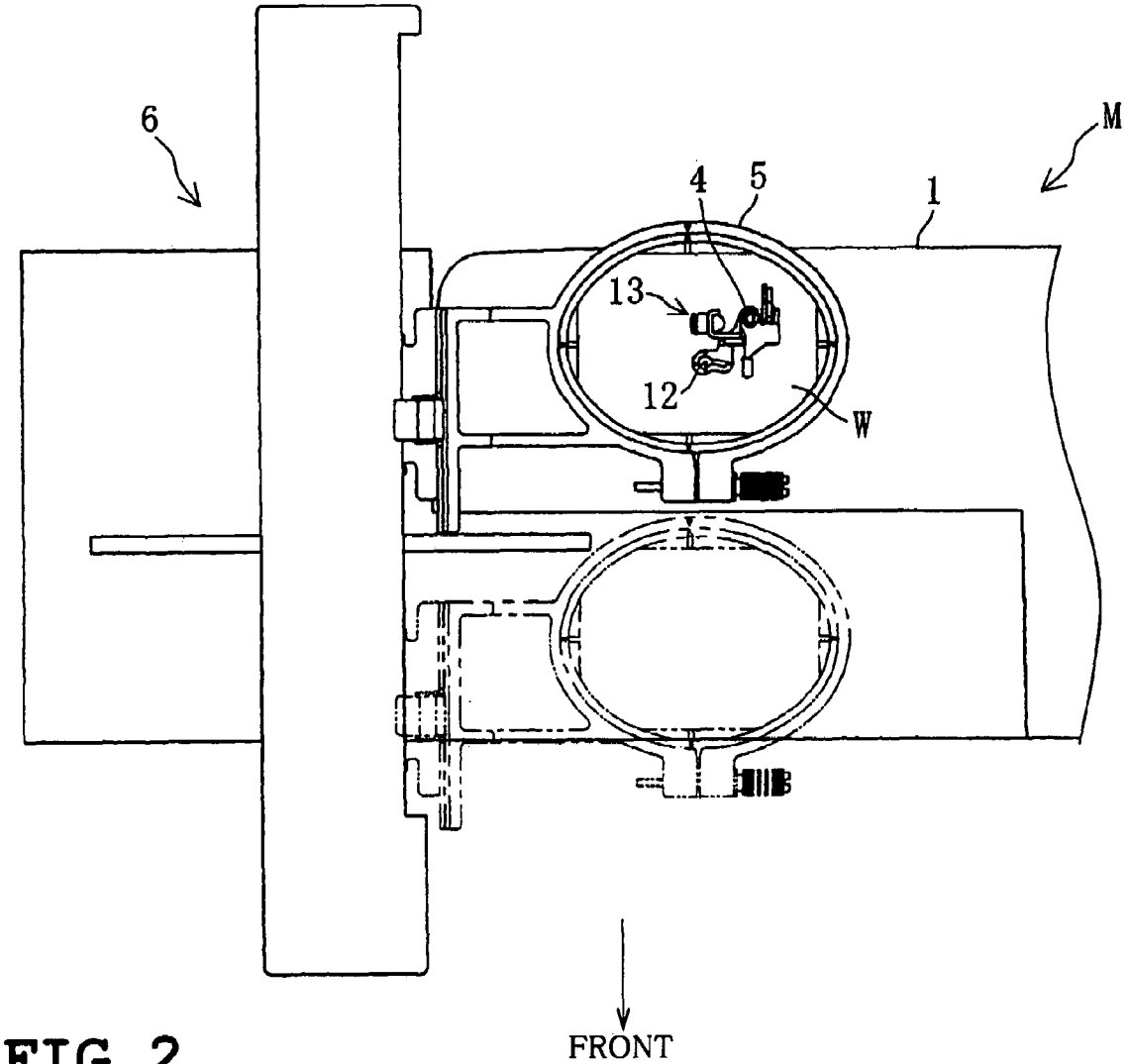
FIG. 2 is a plan view a sewing machine head, an embroidery frame transferring device, and an embroidery frame.
Figure 3C:
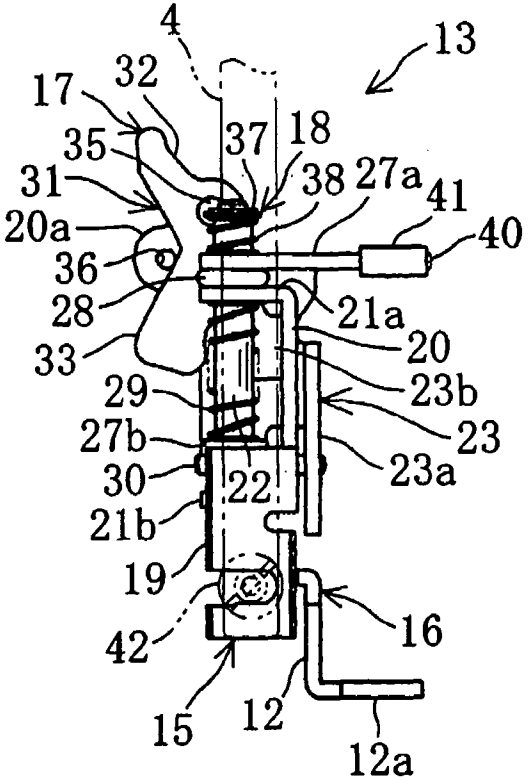
FIG. 3C is a left side view of the embroidery presser.
Figure 3B:
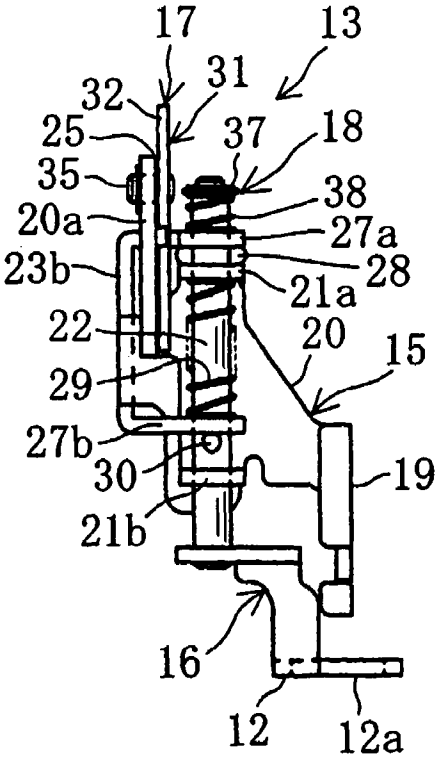
FIG. 3B is a rear view of the embroidery presser.
Figure 3A:
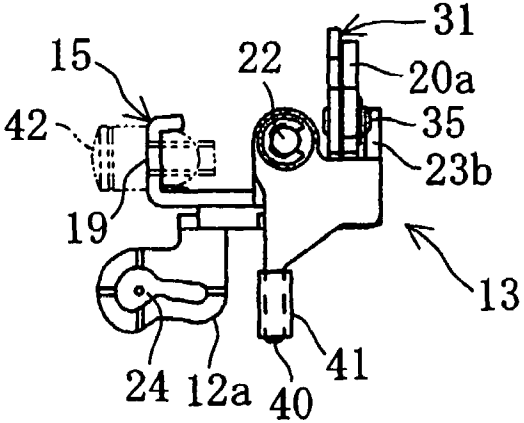
FIG. 3A is a plan view of an embroidery presser.
Figure 3E:
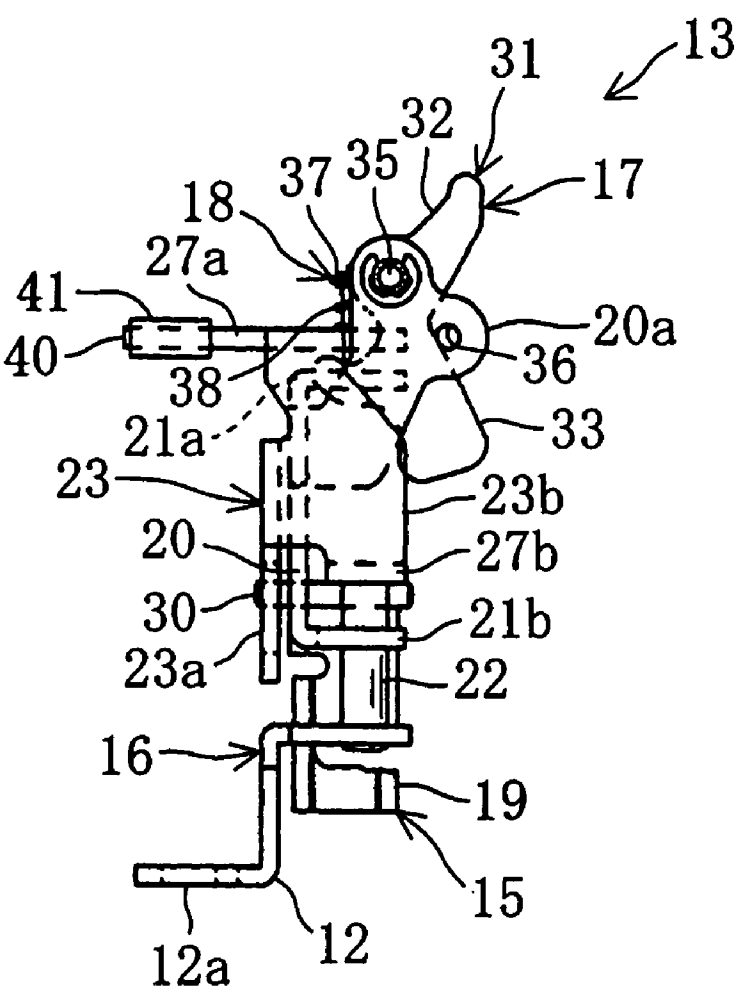
FIG. 3E is a right side view of the embroidery presser.
Figure 3D:
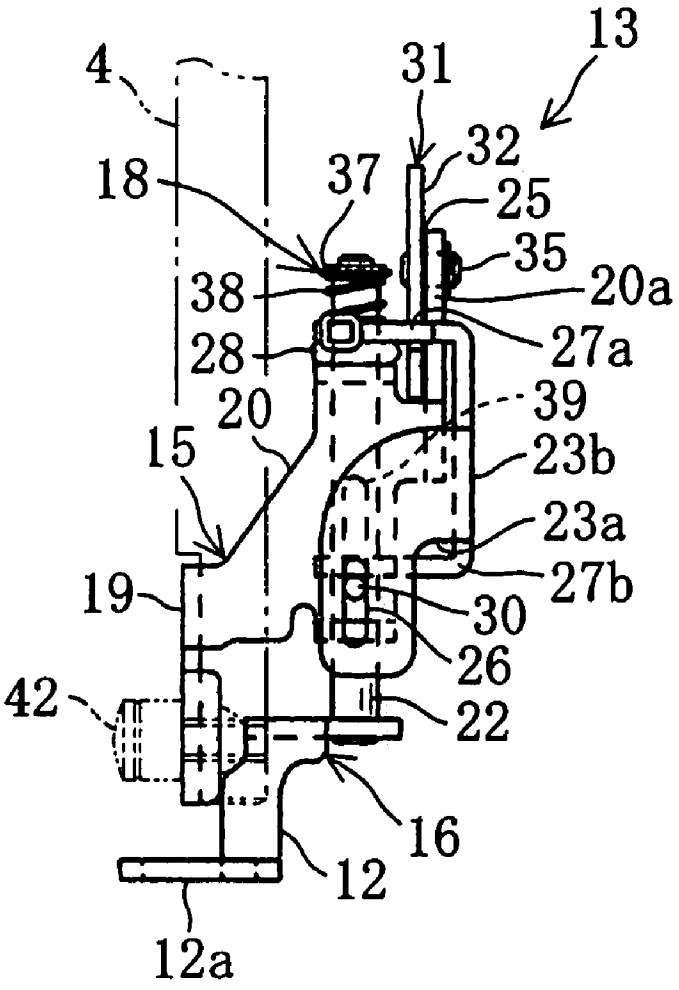
FIG. 3D is a front view of the embroidery presser.

Referring to FIG. 2, the embroidery frame transferring device 6 is controlled based on embroidery data so as to drive the embroidery frame 5 in an X direction (left and right) and Y direction (back and forth) individually. A plurality of embroidery frames are selectively attached to and detached from the embroidery frame transferring device 6. The embroidery frames differ from one another in the size and/or shape of a cloth holding portion holding the workpiece cloth W.

Returning to FIG. 1, an operation panel 7 is mounted on a front surface of the pillar 2. The arm 3 includes a main shaft (not shown) driven by a sewing machine motor (not shown) and extending laterally and a hand pulley 8 driven so that the main shaft is manually rotated. The arm 3 also includes a needle bar driving mechanism (not shown) which vertically moves a needle bar 10 having a lower end to which a sewing needle 9 is mounted. The arm 3 further includes a needle thread take-up driving mechanism which vertically moves a needle thread take-up in synchronization with the vertical movement of the sewing needle 9. A sewing start/stop switch 11 is mounted on the front of the arm 3 and is operated so that sewing is started and stopped. The bed 1 is provided with a thread-capturing shuttle driven by a sewing machine motor (not shown) and a cloth feed mechanism (not shown) driving a feed dog. Since the aforementioned mechanisms are similar to those of ordinary sewing machines, detailed description of the mechanisms will be eliminated. In the following description, left-and-right and back-and-forth directions refer to those directions as viewed in FIGS. 1 and 2.

A presser bar 4 is mounted on a sewing machine frame of the head of the arm 3 so as to be vertically movable. The presser bar 4 is switchable between a lifted position and a lowered position when a presser lifting operation lever 14 disposed at a lower part of the head of the arm 3 is operated so as to be ascended and descended. The presser bar 4 has a lower end to which an embroidery presser 13 is fixed by a screw 42. When the needle bar 10 is moved up and down, the workpiece cloth W is intermittently pressed by the embroidery presser 13 in synchronization with the up and down movement of the needle bar 10.

The embroidery presser 13 will be described. Referring to FIGS. 3A to 4E, the embroidery presser 13 includes a holder 15 adapted to be detachably fixed to a lower end of the presser bar 4 and a presser foot 16 which is mounted on the holder 15 so as to be vertically movable. The embroidery presser 13 also includes a biasing member 29 normally biasing the presser foot 16 elastically downward relative to the holder 15. The embroidery presser 13 further includes a presser lifting mechanism 17 and a moving mechanism 18. The presser lifting mechanism 17 has a function of lifting the presser foot 16 relative to the holder 15 when the presser bar 4 is switched to the lifted position by the presser lifting operation lever 14. The moving mechanism 18 allows the presser foot 16 to be moved further downward by the downward movement of the needle bar 10.

The holder 15 will now be described. Referring to FIGS. 3A to 3E, the holder 15 comprises a mount 19 fixed to a left side of the lower end of the presser bar 4 and a holder body plate 20 located at the front. The holder 15 further comprises supports 21*a* and 21*b* which support the presser foot 16 so as to be ascended and descended and a right side plate 20*a* which is bent at a right end of the holder body plate 20 rearward perpendicularly so as to extend upward.

The mount 19 is generally formed into a C-shape and detachably fixed to the left side lower end of the presser bar 4 by a fastening screw 42. The holder body plate 20 is formed integrally on a front end of the mount 19 and extends rightward and obliquely upward. The holder body plate 20 includes a lower part formed with a vertically extending slit 39 (see FIG. 3D). The holder body plate 20 has upper and lower ends formed with a pair of supports 21*a* and 21*b* bent rearward at a right angle respectively. A support shaft 22 which is a part of the presser foot 16 and extends through the supports 21*a* and 21*b* so as to be vertically slidable. The holder 15 includes a right side plate 20*a* rearwardly extending obliquely upward.

The presser foot 16 will be described. The presser foot 16 includes a cranked pressing member 12 having a lower end including a cloth pressing portion 12*a*. The presser foot 16 also includes an auxiliary part 23 supported on the support shaft 22. The pressing member 12 has a stepped rear end fixed to the lower end of the support shaft 22. The pressing member 12 also has a front end including a lower end on which the cloth pressing portion 12*a* is formed. The cloth pressing portion 12*a* is formed with a through hole 24 through which a sewing needle 9 passes.

The auxiliary member 23 includes a front plate 23*a* and a right side plate 23*b* bent at a right end of the front plate 23*a* rearward at a right angle. The front plate 23*a* and the right side plate 23*b* are integrally formed with each other. The front plate 23*a* has a vertically extending slit 26 which is formed so as to overlap the front of the slit 39. The right side plate 23*b* has upper and lower ends formed with a pair of upper and lower horizontal support pieces 27*a* and 27*b* bent leftward at a right angle respectively. The support pieces 27*a* and 27*b* have through holes through which the support shaft 22 extends, respectively. The support piece 27*a* is disposed on the upper side of the support 21*a* with a buffer O-ring 28 interposed therebetween, whereas the support piece 27*b* is disposed between a pair of upper and lower supports 21*a* and 21*b*.

A horizontal limit pin 30 extends through the slit 26 in the back-and-forth direction to be fixed. The limit pin 30 is located at a position about one third of the length of the support shaft 22 below the support piece 27*b*. The limit pin 30 extends through the slits 39 and 26 so as to be slidable vertically, thereby limiting rotation of the support shaft 22 and the auxiliary part 23 about a central axis of the support shaft 22. Accordingly, rotation of the presser foot 16 about the support shaft 22 is also limited. The support piece 27*a* has an auxiliary operating portion 40 forwardly extending horizontally. A tube 41 with a smaller diameter is fitted with the auxiliary operating portion 40 so as to cover the portion 40. The tube 41 is made from an elastic resin.

The biasing member 29 comprises a compression coil spring, for example and is provided about the support shaft 22 located between the underside of the support 21*a* and an upper face of the support piece 27*b*, thereby elastically biasing the auxiliary part 23 downward relative to the holder 15. The underside of the support piece 27*a* is held in abutment with the upper side of the support 21*a* by a biasing force of the biasing member 29 with the O-ring 28 being interposed therebetween.

The elastic member 38 comprises a compression coil spring, for example and is provided about the support shaft 22 between the underside of a spring bracket ring 37 and the upper side of the support piece 27*a*, thereby elastically biasing the support shaft 22 upward relative to the auxiliary part 23. The limit pin 30 fixed to the support shaft 22 is held in abutment with the underside of the support piece 27*b* by an elastic force of the elastic member 38.

In the above-described construction, when the auxiliary part 23 is lifted against the biasing force of the biasing member 29 relative to the holder 15, the support shaft 22 is lifted while the underside of the support piece 27*b* and the limit pin 30 are held in abutment with each other by the elastic force of the elastic member 38. That is, the auxiliary part 23 and the presser foot 16 are lifted together.

On the other hand, when a pressing force pressing the presser foot 16 downward acts on the holder 15, the elastic member 38 is compressed and the limit pin 38 is parted downward from the underside of the support piece 27*b*, whereupon the presser foot 16 moves downward. When the holder 15 is released from the pressing force, the elastic force of the elastic part 38 causes the limit pin 30 to re-abut against the underside of the support piece 27*b*.

The presser lifting mechanism 17 will now be described. When the presser-lifting operation lever 14 is operated so that the presser bar 4 is lifted, the presser lifting mechanism 17 abuts against the sewing machine frame thereby to lift the presser foot 16 relative to the holder 15. The presser lifting mechanism 17 has a presser-lifting pivotable lever 31 which is mounted on a pivot pin 35 so as to be pivotable. The pivot pin 35 extends in the right-and-left direction. The pivotable lever 31 includes an abutment 32, a middle pressing output 34 and a pressing operation portion 33.

The abutment 32 is formed on an upper end of the pivotable lever 31 so as to rearwardly extend obliquely upward. The abutment 32 protrudes higher than the holder 15 and the right side plate 20*a*, thereby being capable of abutting against the sewing machine frame. The middle pressing output 34 is in abutment with the support piece 27*a*. When the abutment 32 abuts against the sewing machine frame to pivot clockwise as viewed at the right side, the support piece 27*a* is pushed upward, whereby the presser foot 16 is lifted relative to the holder 15.

The pressing operation portion 33 is formed on a lower half of the presser-lifting pivotable lever 31 and protrudes in the rear of the right side plate 20*a* of the holder 15. When the embroidery presser 13 is attached to the presser bar 4, the pressing operation portion 33 is pressed forward so that the pivotable lever 31 is caused to pivot, whereby the abutment 32 can be prevented from interference with the sewing machine frame. Additionally, a spring washer 25 is held between right side plate 20*a* of the holder 15 and the pivot lever 31 to prevent rattle. When the presser-lifting operation lever 14 is operated so that the presser bar 4 is lifted, an upper end of the abutment 32 abuts against the sewing machine frame. Furthermore, the right side plate 20*a* of the holder 15 has a limiting convex portion 36 which limits pivotal movement of the pressing output 34 of the pivotable lever 31 in such a direction that the pressing output 34 departs from the support piece 27*a*.

The moving mechanism 18 will be described. The moving mechanism 18 allows the cloth pressing portion 12*a* to be moved further downward by the downward movement of the needle bar 10 from the lowered position located lower than the holder 15 by the elastic force of the elastic member 38. The elastic member 38 returns the cloth pressing portion 12*a* to the lowered position by the upward movement of the needle bar 10.

The embroidery presser 13 operates as follows. Firstly, the upper end of the abutment 32 tends to interfere with the sewing machine frame when the embroidery presser 13 is attached to the presser bar 4 at the front of the sewing machine M. Accordingly, the pressing operation portion 33 of the presser-lifting pivotable lever 31 is manually pressed forward so that the lever 31 is caused to pivot, whereby an amount of upward protrusion of the abutment 15 is reduced. As a result, since the interference is avoided between the upper end of the abutment 32 and the sewing machine frame, the embroidery presser 13 can easily be mounted on the presser bar 4.

Figure 4B:
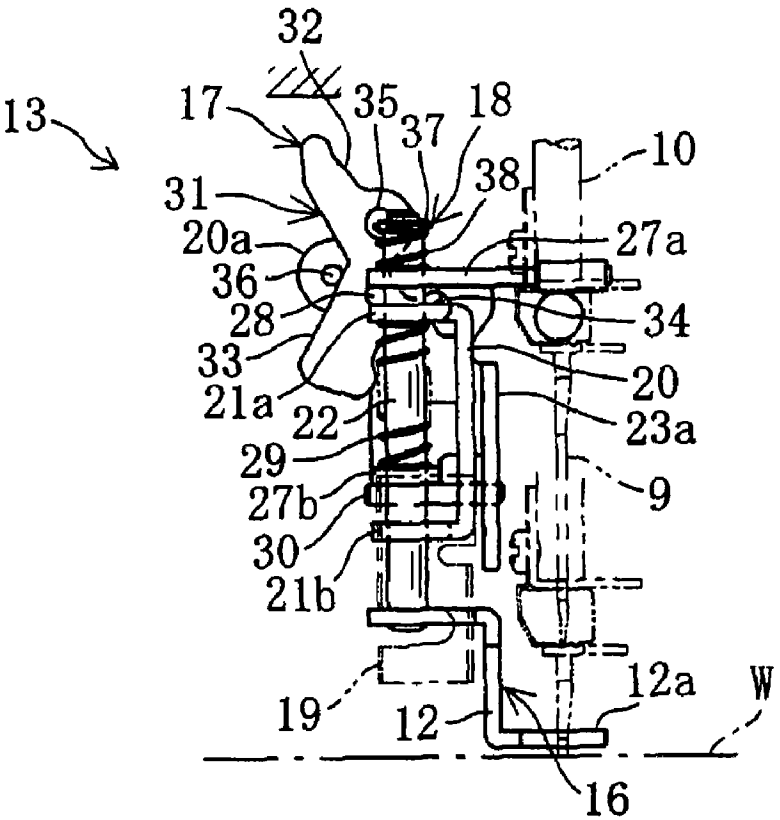
FIG. 4B is a left side view of the embroidery presser, showing the presser foot dropped by the descent of the needle bar during embroidery sewing.
Figure 4A:
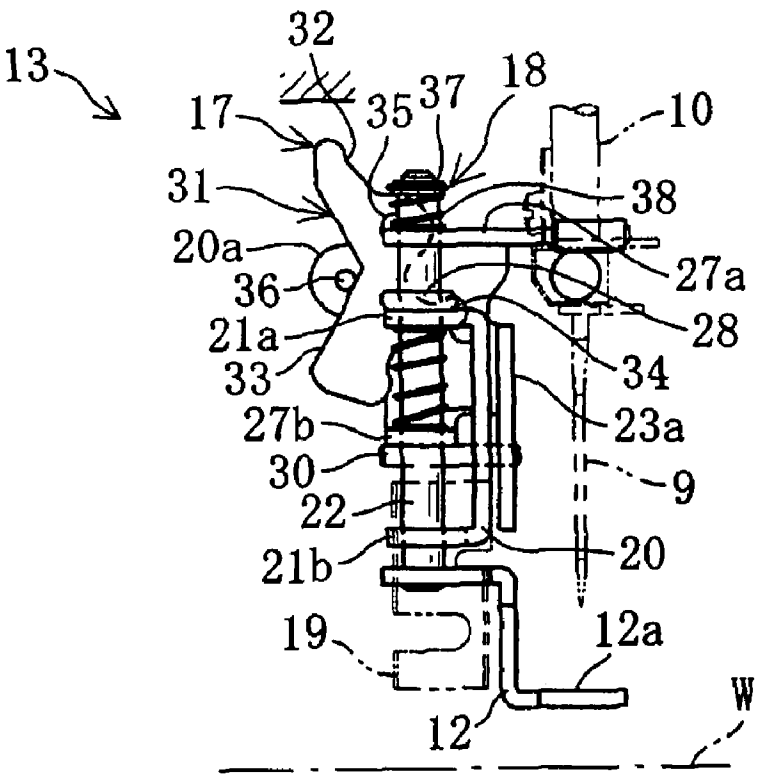
FIG. 4A is a left side view of the embroidery presser, showing a presser foot lifted by the ascent of a needle bar during embroidery sewing.

Furthermore, FIG. 4A shows the presser foot 16 lifted by the ascent of a needle bar 10 during embroidery sewing. FIG. 4B shows the presser foot 16 dropped by the descent of the needle bar during embroidery sewing. In the embodiment, as shown in FIG. 4B, the underside of the cloth presser 12*a* is adapted to be slightly spaced from the upper side of the workpiece cloth W without being in contact with the workpiece cloth when the presser foot 16 is located at the lowered position. The reason for this is that when embroidery is sewn on the workpiece cloth having a small thickness, sound due to collision of the cloth pressing portion 12*a* against the needle plate located below the workpiece cloth W needs to be reduced or after the sewing needle 9 is drawn from the workpiece cloth W, an embroidery sewing speed needs to be increased so that start of movement of the workpiece cloth W held on the embroidery frame 5 is advanced.

Thus, the cloth pressing portion 12*a* is not designed to press the workpiece cloth W downward positively. The cloth pressing portion 12*a* is set so as to restrain the workpiece cloth W from ascending with the sewing needle 9 when the sewing needle 9 is stuck to the workpiece cloth 9 and thereafter is caused to be lifted thereby to be drawn out of the workpiece cloth W. Of course, the cloth pressing portion 12*a* may be set so as to press the workpiece cloth W downward in a positive manner as in conventional embroidery pressers.

Figure 4E:
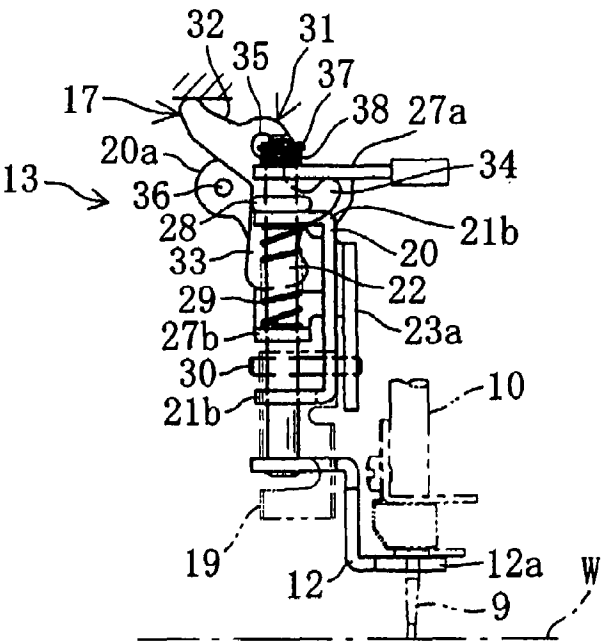
FIG. 4E is a left side view of embroidery presser, showing the cloth pressing portion pushed downward by the descent of the needle bar when the embroidery presser assumes a lifted position.
Figure 4D:
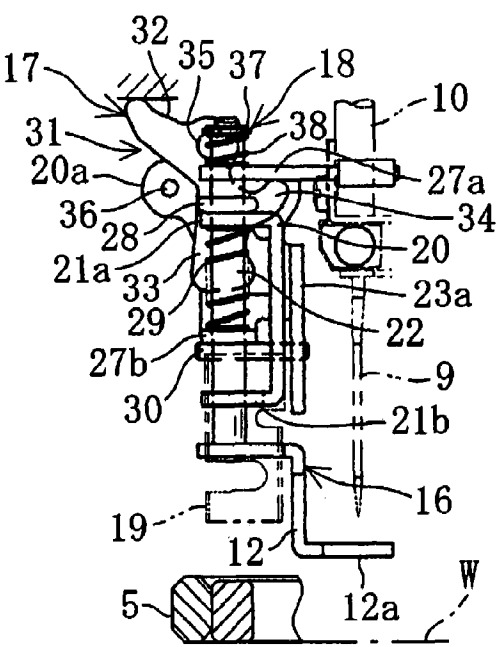
FIG. 4D is a left side view of the embroidery presser, showing the presser foot lifted by rotation of the presser lifting rotatable lever when the embroidery presser assumes a lifted position.
Figure 4C:
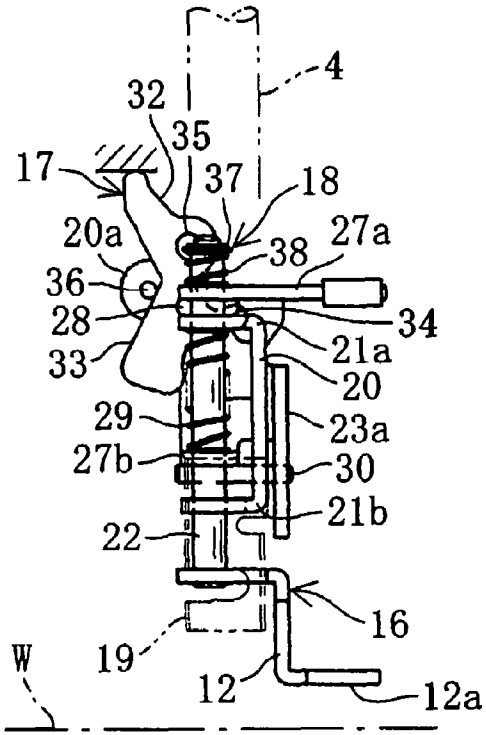
FIG. 4C is a left side view of the embroidery presser, showing an abutment of a presser lifting rotatable lever in abutment with a sewing machine frame during ascent of the embroidery presser with ascent of a presser bar

Next, upon completion of the embroidery sewing, the presser lifting operation lever 14 is operated so that the embroidery frame 5 is detached from the embroidery frame transferring device 6. FIG. 4C shows the presser bar 4 and the embroidery presser 13 being lifted. In FIGS. 4A to 4E, a slashed part over the abutment 32 designates an abutted part of the sewing machine frame. As shown in FIG. 4C, the abutment 32 abuts against the sewing machine frame in the middle of the lifting of the presser bar 4 and the embroidery presser 13.

Subsequently, when the presser bar 4 and the embroidery presser 13 are further lifted, the presser-lifting pivotable lever 31 is caused to pivot counterclockwise relative to the holder 15, whereupon the pressing output 34 presses the underside of the support piece 27*a* upward. As a result, the presser foot 16 is lifted relative to the holder 15. More specifically, addition of an amount of ascend of the presser bar 4 and an amount of ascend of the support piece 27*a* due to pivotal movement of the lever 31 is equal to an amount of ascend of the presser foot 16. In this case, as shown in FIG. 4*d*, the underside of the cloth pressing portion 12*a* is located higher than the height of the embroidery frame 5. Consequently, the embroidery frame 5 can be detached without contact with the cloth pressing portion 12*a*.

On the other hand, when the presser bar 4 and the embroidery presser 13 assume a lifted position, it is supposed that the operator may turn the hand pulley 8 to move the needle bar 10 to the lowered position. FIG. 4E shows the condition in the above case. When the needle bar 10 is lowered, a needle clamp provided for attaching the sewing needle 9 fixed to the lower end of the needle bar 10 and a needle bar thread guide fixed to a lower part of the needle clamp collide against the cloth pressing portion 12*a* assuming the lowered position relative to the holder 15. When the cloth pressing portion 12*a* is further pressed downward, the elastic member 38 is compressed such that the cloth pressing portion 12*a* is moved downward. Subsequently, when the needle bar 10 is lifted thereby to be released from the pressed state, the elastic force of the elastic member 38 returns the cloth pressing portion 12*a* to the lowered position. Thus, since the cloth pressing portion 12*a* is allowed to be further moved downward, the cloth pressing portion 12*a* can be prevented from deformation or breakage due to collision against the needle clamp or needle bar thread guide.

As described above, the embroidery presser 13 is provided with the presser lifting mechanism 17 which abuts against the sewing machine frame and lifts the presser foot 16 relative to the holder 15 when the presser-lifting operation lever 14 for lifting and lowering the presser bar 4 is operated so that the presser bar 4 is lifted. Consequently, since the lifted position of the presser foot 16 is set to a high position, the presser foot 16 can be prevented from contact with or interference against the embroidery frame 5, and the embroidery frame 5 can be attached and detached easily.

Furthermore, since the presser lifting mechanism 17 includes the presser-lifting pivotable lever 31 pivotally mounted on the holder 5, the presser-lifting pivotable lever 31 is abutted against the sewing machine frame so that the presser foot 16 can easily be lifted.

Additionally, the presser-lifting pivotable lever 31 has the abutment 32 which protrudes higher than the holder 15 and can abut against the sewing machine frame. Consequently, the presser foot 16 can be lifted when the presser bar is lifted so as to abut against the sewing machine frame.

The structure and forms of the holder 5, auxiliary part 23, pressing member 16 are mere examples. They may be modified.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

What is claimed is:

1. An embroidery presser for an embroidery machine, comprising:

a sewing machine frame;

a presser bar having a lower end;

a presser-lifting operation lever operated so that the presser bar is vertically moved;

a needle bar movable vertically;

a holder attached to the lower end of the presser bar;

a presser foot supported by the holder so as to be vertically movable and having a lower end provided with a cloth pressing portion intermittently pressing workpiece cloth by a vertical movement of the needle bar;

a biasing member normally biasing the presser foot relative to the holder member elastically downward;

a presser lifting mechanism abutting the sewing machine frame when the presser bar is lifted by operation of the operation lever, thereby lifting the presser foot relative to the holder;

a moving mechanism capable of moving the cloth pressing portion from a lowered position where the cloth pressing portion is located below the holder by a biasing force of the biasing member so that the cloth pressing portion is movable further downward by downward movement of the needle bar; and an elastic member for returning the cloth pressing portion to the lowered position by lifting movement of the needle bar.

2. The embroidery presser according to claim 1, wherein the presser lifting mechanism includes a presser-lifting pivotable lever which is mounted on the holder so as to be pivotable.

3. The embroidery presser according to claim 2, wherein the presser-lifting pivotable lever includes an abutting portion protruding above the holder and being capable of abutting the sewing machine frame.

4. The embroidery presser according to claim 2, wherein the presser-lifting pivotable lever has a pressing operation portion manually lifting the presser foot relative to the holder.

5. The embroidery presser according to claim 1, wherein the presser foot includes a support shaft; the biasing member includes a first compression coil spring; and the elastic member includes a second compression coil spring, the first and second compression coil springs being provided about the support shaft in series to each other.

* * * * *